US006664035B1

(12) United States Patent
Haye et al.

(10) Patent No.: US 6,664,035 B1
(45) Date of Patent: Dec. 16, 2003

(54) METHOD OF USE OF STABILIZED RAPID ACCESS COLOR DEVELOPERS FOR COLOR NEGATIVE FILM

(75) Inventors: Shirleyanne Haye, Rochester, NY (US); Robert A. Arcus, Penfield, NY (US); Janet M. Huston, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/706,463

(22) Filed: Nov. 3, 2000

(51) Int. Cl.[7] ..... G03C 7/407
(52) U.S. Cl. ..... 430/435; 430/490
(58) Field of Search ..... 430/435, 490

(56) References Cited

U.S. PATENT DOCUMENTS

| | | | | |
|---|---|---|---|---|
| 4,892,804 A | | 1/1990 | Vincent et al. | 430/380 |
| 4,897,339 A | | 1/1990 | Andoh et al. | 430/372 |
| 4,906,554 A | | 3/1990 | Ishikawa et al. | 430/467 |
| 5,094,937 A | | 3/1992 | Morimoto | 430/485 |
| 5,273,865 A | * | 12/1993 | Loiacono et al. | 430/490 |
| 5,278,034 A | | 1/1994 | Ohki et al. | 430/440 |
| 5,660,973 A | | 8/1997 | Ishikawa et al. | 430/444 |
| 5,827,635 A | | 10/1998 | Cole | 430/372 |
| 6,005,111 A | | 12/1999 | Taniguchi et al. | 546/166 |

FOREIGN PATENT DOCUMENTS

| | | |
|---|---|---|
| EP | 0 520 457 | 12/1992 |

* cited by examiner

*Primary Examiner*—Hoa Van Le
(74) *Attorney, Agent, or Firm*—Sarah Meeks Roberts

(57) ABSTRACT

A method for providing a color image in an exposed color negative silver bromoiodide film element comprising contacting said element with an aqueous color developing composition having a pH of 9.0 to 12.0 and comprising a color developing agent, sulfite ion and an additional antioxidant wherein the color developing agent/sulfite ion molar ratio is less than 10:1 and greater than 0.55:1, and the sulfite ion/antioxidant molar ratio is less than 4.35:1 and greater than 0.25:1.

18 Claims, No Drawings

METHOD OF USE OF STABILIZED RAPID ACCESS COLOR DEVELOPERS FOR COLOR NEGATIVE FILM

FIELD OF THE INVENTION

This invention relates to photographic processing of color photographic elements. More specifically, this invention relates to the use of stabilized alkaline color developer compositions in the rapid processing of color negative film.

BACKGROUND OF THE INVENTION

The basic processes for obtaining useful color images from exposed color photographic silver halide materials include several steps of photochemical processing such as color development, silver bleaching, silver halide fixing and water washing or dye image stabilizing using appropriate photochemical compositions and automatic processing machines. Photographic color developing compositions are used to provide the desired dye images early in the photoprocessing method. Such compositions generally contain color developing agents, for example 4-amino-3-methyl-N-(2-methane sulfonamidoethyl)aniline, as reducing agents to react with suitable color forming couplers to form the desired dyes Traditionally, this service has required one or two days for providing the customer with the desired prints. In recent years, customers have wanted faster service, and in some locations known as "mini-labs", it is desired to provide the customer with the desired prints within an hour. This requires the photoprocessing methods to be even faster, and reducing the processing time to within a few minutes is the ultimate desire in the industry. Much effort has been directed towards co-optimizing photographic film/paper and processes for very short processing times of two minutes or less.

Reduction in processing time of the "display" elements or color photographic papers has been facilitated by a number of recent innovations, including the use of predominantly silver chloride emulsions in the display elements. U.S. Pat. No. 4,892,804 (Vincent et al) describes conventional color developing compositions for use with high chloride photographic elements that have found considerable commercial success in the photographic industry.

Color negative films, however, generally comprise little or no silver chloride in their emulsions, and generally have silver bromide as the predominant silver halide. More typically, the emulsions are silver bromoiodide emulsions with silver iodide levels up to several mol percent. Such films require these types of emulsions because emulsions containing high silver chloride have not demonstrated sufficient light sensitivity to be used as camera speed materials although they have the advantage of being rapidly processed without major changes to the color developer solution.

To shorten the processing time, specifically the color development time, of films containing silver bromoiodide emulsions, more active color developer solutions are needed. While more active color developers may be obtained by either increasing the pH, the temperature or the color developing agent concentration of the color developer or by decreasing the halide ion concentration of the developer; these methods often compromise the stability of the developer solution and the photographic image quality. Photographic image quality may be corrected by scanning and digitally adjusting the image from a chemically processed color negative film. This technology, however, does not address the problem of maintaining the stability of processing solutions for extended periods of time at high temperatures.

For Black and White developers, high levels of sulfite or combinations of sulfite and borax are generally used to protect the developing agent against oxidation in many rapid access developers. In color systems, although sulfite is oftentimes used, other methods have been proposed to overcome problems encountered in rapid processing. For instance, novel antioxidants have been developed to stabilize developer solutions used with high chloride silver halide elements in U.S. Pat. No. 4,897,339 of Andoh et al, U.S. Pat. No. 4,906,554 of Ishikawa et al, and U.S. Pat. No. 5,094,937 of Morimoto. Also, specific hydroxylamine antioxidant, were suggested in U.S. Pat. No. 5,827,635 for rapid color development of silver bromoiodide films, and novel color developing agents have been proposed for rapid development in U.S. Pat. No. 5,278,034 (Ohki et al).

There is still a need, however, for a color developer which is active enough to rapidly process bromoiodide color negative films but is also stable under such rapid processing conditions.

SUMMARY OF THE INVENTION

This invention provides a method for providing a color image in an exposed color negative silver bromoiodide film element comprising contacting said element with an aqueous color developing composition having a pH of 9.0 to 12.0 and comprising a color developing agent, sulfite ion and an additional antioxidant wherein the color developing agent/sulfite ion molar ratio is less than 10:1 and greater than 0.55:1, and the sulfite ion/ antioxidant molar ratio is less than 4.35:1 and greater than 0.25:1.

The method of this invention allows for rapid color development of camera ready film elements containing a silver bromoiodide emulsion. The color developer solutions are remarkably stable against aerial oxidation even when maintained and/or used at relatively high temperatures, that is, above 45° C. for lengthy periods of time.

DETAILED DESCRIPTION OF THE INVENTION

The color developing compositions used in this invention include one or more color developing agents that are well known in the art that, in oxidized form, will react with dye forming color couplers in the processed materials. Such color developing agents include, but are not limited to, aminophenols, p-phenylenediamines (especially N,N-dialkyl-p-phenylenediamines) and others which are well known in the art, such as EP 0 434 097A1 (published Jun. 26, 1991) and EP 0 530 921A1 (published Mar. 10, 1993). It may be useful for the color developing agents to have one or more water-solubilizing groups as are known in the art. Further details of such materials are provided in Research Disclosure, publication 38957, pages 592–639 (September 1996).

Preferred color developing agents include, but are not limited to, N,N-diethyl p-phenylenediamine sulfate (KODAK Color Developing Agent CD-2), 4-amino-3-methyl-N-(2-methane sulfonamidoethyl)aniline sulfate, 4-(N-ethyl-N-p-hydroxyethylamino)-2-methylaniline sulfate (KODAK Color Developing Agent CD-4), p-hydroxyethylethylaminoaniline sulfate, 4-(N-ethyl-N-2-methanesulfonylaminoethyl)-2-methylphenylenediamine sesquisulfate (KODAK Color Developing Agent CD-3), 4-(N-ethyl-N-2-methanesulfonylaminoethyl)-2-methylphenylenediamine sesquisulfate, and others readily apparent to one skilled in the art. Particularly suitable for use in the current invention is 4-(N-ethyl-N-p-hydroxyethylamino)-2-methylaniline sulfate (KODAK Color Developing Agent CD-4)

In order to protect the color developing agents from oxidation, one or more antioxidants are generally included in the color developing compositions. In the developer compositions used in the invention both a sulfite compound (such as sodium sulfite, potassium sulfite, sodium bisulfite and potassium metabisulfite) and an additional antioxidant are utilized. Either inorganic or organic antioxidants can be used as the additional antioxidant. Many classes of useful antioxidants are known, including but not limited to, hydroxylamine (and derivatives thereof), hydrazines, hydrazides, amino acids, ascorbic acid (and derivatives thereof), hydroxamic acids, aminoketones, mono- and polysaccharides, mono- and polyamines, quaternary ammonium salts, nitroxy radicals, alcohols, and oximes. Also useful as antioxidants are 1,4-cyclohexadiones as described in U.S. Pat. No. 6,077,653. Mixtures of compounds from the same or different classes of antioxidants can also be used if desired.

The most preferred antioxidant for use in this invention is hydroxylamine sulfate. Other useful antioxidants are hydroxylamine derivatives as described for example, in U.S. Pat. No. 4,892,804 (Vincent et al), U.S. Pat. No. 4,876,174 (Ishikawa et al), U.S. Pat. No. 5,354,646 (Kobayashi et al) and U.S. Pat. No. 5,660,974 (Marrese et al), and U.S. Pat. No. 5,646,327 (Bums et al), the disclosures of which are all incorporated herein by reference with respect to antioxidants. Many of these antioxidants are mono- and dialkylhydroxylamines having one or more substituents on one or both alkyl groups. Particularly useful alkyl substituents include sulfo, carboxy, amino, sulfonamido, carbonamido, hydroxy and other solubilizing substituents.

The noted hydroxylamine derivatives can be mono- or dialkylhydroxylamines having one or more hydroxy substituents on the one or more alkyl groups. Representative compounds of this type are described for example in U.S. Pat. No. 5,709,982 (Marrese et al), incorporated herein by reference, as having the following Structure I:

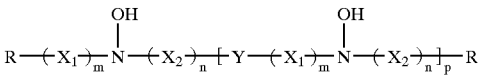

wherein R is hydrogen, a substituted or unsubstituted alkyl group of 1 to 10 carbon atoms, a substituted or unsubstituted hydroxyalkyl group of 1 to 10 carbon atoms, a substituted or unsubstituted cycloalkyl group of 5 to 10 carbon atoms, or a substituted or unsubstituted aryl group having 6 to 10 carbon atoms in the aromatic nucleus.

$X_1$ is $—CR_2(OH)CHR_1—$ and $X_2$ is $—CHR_1CR_2(OH)—$ wherein $R_1$ and $R_2$ are independently hydrogen, hydroxy, a substituted or unsubstituted alkyl group or 1 or 2 carbon atoms, a substituted or unsubstituted hydroxyalkyl group of 1 or 2 carbon atoms, or $R_1$ and $R_2$ together represent the carbon atoms necessary to complete a substituted or unsubstituted 5- to 8-membered saturated or unsaturated carbocyclic ring structure.

Y is a substituted or unsubstituted alkylene group having at least 4 carbon atoms, and has an even number of carbon atoms, or Y is a substituted or unsubstituted divalent aliphatic group having an even total number of carbon and oxygen atoms in the chain, provided that the aliphatic group has a least 4 atoms in the chain.

Also in Structure I, m, n and p are independently 0 or 1. Preferably, each of m and n is 1, and p is 0.

Specific di-substituted hydroxylamine antioxidants include, but are not limited to: N,N-bis(2,3-dihydroxypropyl)hydroxylamine, N,N-bis(2-methyl-2,3-dihydroxypropyl)hydroxylamine and N,N-bis(1-hydroxymethyl-2-hydroxy-3-phenylpropyl)hydroxylamine. The first compound is preferred.

Also useful are the antioxidants disclosed in U.S. Pat. No. 5,827,635 represented by the formula:

$$R''—L—N(OH)—L'—R'$$

wherein L and L' are independently substituted or unsubstituted alkylene of 1 to 8 carbon atoms (such as methylene, ethylene, n-propylene, isopropylene, n-butylene, 1,1-dimethylethylene, n-hexylene, n-octylene and sec-butylene), or substituted or unsubstituted alkylenephenylene of 1 to 3 carbon atoms in the alkylene portion (such as benzylene, dimethylenephenylene, and isopropylenephenylene).

The alkylene and alkylenephenylene groups can also be substituted with up to 4 substituents that do not interfere with the stabilizing effect of the molecule, or the solubility of the compound in the color developer solution. Such substituents must be compatible with the color developer components and must not negatively impact the photographic processing system. Such substituents include but are not limited to, alkyl of 1 to 6 carbon atoms, fluoroalkyl groups of 1 to 6 carbon atoms, alkoxy of 1 to 6 carbon atoms, phenyl, hydroxy, halo, phenoxy, alkylthio of 1 to 6 carbon atoms, acyl groups, cyano, or amino.

In the noted formula, R" and R' are independently hydrogen, carboxy, sulfo, phosphono, or other acid groups, provided that at least one of R" and R' is not hydrogen. Salts of the acid groups are considered equivalents in this invention. Thus, the free acid forms of the hydroxylamines can be used, as well as the organic or inorganic salts of the acids, such as the alkali metal, pyridinium, tetraethylammonium, tetramethylammonium and ammonium salts. The sodium and potassium salts are the preferred salts. In addition, readily hydrolyzable ester equivalents can also be used, such as the methyl and ethyl esters of the acids. When L or L' is alkylenephenylene, the carboxy, sulfo or phosphono group is preferably at the para position of the phenylene, but can be at other positions if desired. More than one carboxy, sulfo or phosphono group can be attached to the phenylene radical.

Preferably, one or both of R" and R' are hydrogen, carboxy or sulfo, with hydrogen and sulfo (or salts or readily hydrolyzable esters thereof) being more preferred. Most preferably, R is hydrogen and R' is sulfo (or a salt thereof).

Preferably, L and L' are independently substituted or unsubstituted alkylene of 3 to 6 carbon atoms (such as n-propyl, isopropyl, n-butyl, sec-butyl, t-butyl, n-pentyl, 1-methylpentyl and 2-ethylbutyl), or substituted or unsubstituted alkylenephenylene having 1 or 2 carbon atoms in the alkylene portion (such as benzyl, and dimethylenephenyl).

More preferably, at least one, and optionally both, of L and L' is a substituted or unsubstituted alkylene group of 3 to 6 carbon atoms that is branched at the carbon atom directly attached (that is, covalently bonded) to the nitrogen atom of the hydroxylamine molecule. Such branched divalent groups include, but are not limited to, isopropylene, sec-butylene, t-butylene, sec-pentylene, t-pentylene, sec-hexylene and t-hexylene. Isopropylene is most preferred.

In one embodiment, L and L' are the same. In other and preferred embodiments, they are different. In the latter embodiment, L is more preferably a branched alkylene as described above, and L' is a linear alkylene of 1 to 6 carbon atoms (such as methylene, ethylene, n-propylene, n-butylene, n-pentylene and n-hexylene).

Representative hydroxylamine derivatives useful in the practice of this invention include, but are not limited to, N-isopropyl-N-(2-ethanesulfonic acid)hydroxylamine, N,N-bis(propionic acid)hydroxylamine, N,N-bis(2-ethanesulfonic acid)hydroxylamine, N-isopropyl-N-(n-propylsulfonic acid)hydroxylamine, N-2-ethanephosphonic acid-N-(propionic acid)hydroxylamine, N,N-bis(2-ethanephosphonic acid)hydroxylamine, N-sec-butyl-N-(2-ethanesulfonic acid)hydroxylamine, N,N-bis(sec-butylcarboxylic acid)hydroxylamine, N-methyl-N-(p-carboxylbenzyl)hydroxylamine, N-isopropyl-N-(p-carboxylbenzyl)hydroxylamine, N,N-bis(p-carboxylbenzyl) hydroxylamine, N-methyl-N-(p-carboxyl-m-methylbenzyl) hydroxylamine, N-isopropyl-N-(p-sulfobenzyl) hydroxylamine, N-ethyl-N-(p-phosphonobenzyl) hydroxylamine, N-isopropyl-N-(2-carboxymethylene-3-propionic acid)hydroxylamine, and alkali metal salts thereof.

Many of the noted antioxidants (organic or inorganic) are either commercially available or prepared using starting materials and procedures described in the references noted above in describing hydroxylamines.

The aqueous color developing compositions used in the invention have a pH of 9.0 to 12.0, and more preferably a pH of 9.0 to 11.0. The compositions is utilized at a temperature of 40–60 degrees C, preferably at greater than 45 degrees. The color developing agent/sulfite ion molar ratio is less than 10:1 and greater than 0.55:1, and more preferably the color developing agent/sulfite molar ratio is less than 5:1 and greater than 0.75:1. The sulfite ion/antioxidant molar ratio is less than 4.35:1 and greater than 0.25:1 and more preferably the sulfite/ antioxidant molar ratio is less than 4.0:1 and greater than 1.25:1. The aqueous color developing compositions preferably contain the color developing agent in the amount of 0.015 to 0.068 mol/l, and more preferably in the amount of 0.027 to 0.055 mol/l; the sulfite ion in the amount of 0.005 to 0.095 mol/l and more preferably in the amount of 0.038 to 0.089 mol/l; and the additional antioxidant in the amount of 0.012 to 0.050 mol/l and more preferably in the amount of 0.018 to 0.037 mol/l. The most preferred aqueous color developing composition contain the color developing agent in the amount of 0.027 to 0.055 mol/l, the sulfite ion in the amount of 0.038 to 0.089 mol/l and the additional antioxidant in the amount of 0.018 to 0.037 mol/l.

Buffering agents are generally present in the color developing compositions used in this invention to provide or maintain desired alkaline pH of from about 9 to about 12, and more preferably from about 9 to about 1. These buffering agents must be soluble in the organic solvent described herein and have a pKa of from about 9 to about 13. Such useful buffering agents include, but are not limited to carbonates, borates, tetraborates, glycine salts, triethanolamine, diethanolamine, phosphates and hydroxybenzoates. Alkali metal carbonates (such as sodium carbonate, sodium bicarbonate and potassium carbonate) are preferred buffering agents. Mixtures of buffering agents can be used if desired.

In addition to buffering agents, pH can also be raised or lowered to a desired value using one or more acids or bases. It may be particularly desirable to raise the pH by adding a base, such as a hydroxide (for example sodium hydroxide or potassium hydroxide).

An optional but preferred component of the color developing compositions used in this invention is a photographically inactive, water-miscible or water-soluble, straight-chain organic solvent that is capable of dissolving color developing agents in their free base forms. Such organic solvents can be used singly or in combination, and preferably each has a molecular weight of at least 50, and preferably at least 100, and generally 200 or less and preferably 150 or less. Such preferred solvents generally have from 2 to 10 carbon atoms (preferably from 2 to 6 carbon atoms, and more preferably from 4 to 6 carbon atoms), and can additionally contain at least two nitrogen or oxygen atoms, or at least one of each heteroatom. The organic solvents are substituted with at least one hydroxy functional group, and preferably at least two of such groups. They are straight-chain molecules, not cyclic molecules.

By "photographically inactive" is meant that the organic solvents provide no substantial positive or negative effect upon the color developing function of the concentrate.

Useful organic solvents include, but are not limited to, polyols including glycols (such as ethylene glycol, diethylene glycol and triethylene glycol), polyhydroxyamines (including polyalcoholamines), and alcohols (such as ethanol and benzyl alcohol). Glycols are preferred with ethylene glycol, diethylene glycol and triethylene glycol being most preferred. Of the alcohols, ethanol and benzyl alcohol are most preferred. The most preferred organic solvent is diethylene glycol.

The solution can also include one or more of a variety of other addenda which are commonly used in such compositions, such as alkali metal halides (such as potassium chloride, potassium bromide, sodium bromide and sodium iodide), metal sequestering agents (such as polycarboxylic or aminopolycarboxylic acids or polyphosphonates), buffers (as noted above), other preservatives (such as sulfites and alcoholamines), antifoggants, development accelerators, optical brighteners, wetting agents, stain reducing agents, surfactants, defoaming agents, and water-soluble or water-dispersible color couplers, as would be readily understood by one skilled in the art (see for example, Research Disclosure, noted above and U.S. Pat. No. 4,814,260 of Koboshi et al). The amounts of such additives are well known in the art also. For example, the amounts of halides can be varied widely, but are generally at least about $5\times10^{-5}$ to about 0.4 mol/l for bromide ion and at least about $5\times10^{-7}$ and up to about 0.01 mol/l for iodide ion. The color developing solution may or may not contain chloride ion because chloride ion essentially has no effect on the efficacy of the color developer composition. Thus, generally, chloride ion is not added or present, but if it is, it is not detrimental to the invention. It is more important that some bromide and iodide ions be present in the color developer solution.

It is preferred that no lithium or magnesium ions are purposely added to the color developing compositions used in this invention. Depending upon the concentrations of such ions in water used to make up processing solutions, or carried over from previous processing baths, the total concentration (that is, the sum) of these ions remains preferably very low, that is less than 0.0001 mol/l in the compositions, and preferably a total of less than 0.00001 mol/l.

The color developing composition is preferably formulated and used as an aqueous solution, either as the working developer solution or as a replenishing solution. However, as is known in the art, they can also be formulated and used as dry tablets. The technology for this is readily known in the art, such as U.S. Pat. No. 5,362,610 (Yoshimoto), U.S. Pat. No. 5,376,509 (Yoshimoto et al) and EP-A-0 611 986A1 (published Aug. 24, 1994).

The photographic elements to be developed can be exposed with various forms of energy which encompass the ultraviolet, visible, and infrared regions of the electromagnetic spectrum as well as the electron beam, beta radiation, gamma radiation, x-ray, alpha particle, neutron radiation, and other forms of corpuscular and wave-like radiant energy in either noncoherent (random phase) forms or coherent (in phase) forms, as produced by lasers. When the photographic elements are intended to be exposed by x-rays, they can include features found in conventional radiographic elements.

The photographic elements are preferably exposed to actinic radiation, typically in the visible region of the spectrum, to form a latent image, and then processed to form a visible dye image. Development is typically followed by the conventional steps of bleaching, fixing, or bleach-fixing, to remove silver or silver halide, washing, and drying.

Processing according to the present invention can be carried out using conventional deep tanks holding processing solutions or automatic processing machines. Alternatively, it can be carried out using what is known in the art as "low volume thin tank" processing systems, or LVTT, which have either a rack and tank or automatic tray design. Such processing methods and equipment are described, for example, in U.S. Pat. No. 5,436,118 (Carli et al) and publications noted therein. Processing can also be carried out in minilabs. In one embodiment a method of processing may be utilized which comprises the steps of loading the photographic material into a chamber adapted to hold the material therein, introducing a metered amount of solution into the chamber, rotating the chamber and continuously sweeping the surface of the material as the chamber rotates to thereby form a wave in the solution through which the material passes, the whole volume of solution for a given stage being spread over the whole material area in a repetitive manner to enable uniform processing.

The length of time and temperatures used for each processing step of the present invention, other than color development, can be any desired condition, whether conventional or not.

The color developer solutions described herein are stable when stored and/or used at the elevated temperatures described herein for extended periods of time, for example up to 300 hours. Typically, such temperatures are encountered during rapid photoprocessing methods where the silver bromoiodide films described below are color developed after imagewise exposure. For color development, the processing temperature is generally from about 45 to about 65° C., preferably from about 50 to about 65° C., and more preferably from about 50 to about 60° C. Most preferably, the development temperature is from about 55 to about 60° C.

The time for color development is from about 20 to about 150 seconds, with a time of from about 30 to about 120 seconds being preferred, and a time of from about 30 to about 90 seconds being more preferred. The overall processing time (from development to final rinse or wash) can be from about 50 seconds to about 40 minutes. Shorter overall processing times, that is, less than about 3 minutes, are desired for processing photographic color negative films according to this invention.

The color developing composition is used to provide a color image in an exposed color negative silver bromoiodide film element. The color negative film element comprises a support and one or more silver halide emulsion layers (or color records) containing an imagewise distribution of developable silver halide emulsion grains, and has one or more color forming couplers associated therewith. A wide variety of types of photographic films containing various types of emulsions can be processed using the present invention, the types of elements being well known in the art. Representative color negative films that can be processed using the present invention include, but are not limited to, KODAK MAX™ films, KODAK ADVANTIX™ films, KODAK ROYAL GOLD® films, KODAK GOLD® PLUS 100 film, KODAK GOLD® SUPER 200 film, KODAK GOLD ULTRA 400 film, FUJI SUPER G Plus films, FUJI SMARTFILM™ products, KONICA VX films, KONICA SRG3200 film, 3M SCOTCH® ATG films, and AGFA HDC and XRS films.

Generally, the iodide content of such silver bromoiodide emulsions is less than about 40 mol % (based on total silver), preferably from about 0.05 to about 10 mol %, and more preferably, from about 0.5 to about 6 mol %. The emulsions can be of any crystal morphology (such as cubic, octahedral, cubooctahedral or tabular as are known in the art), or irregular morphology (such as multiple twinning or rounded). Especially useful in this invention are tabular grain silver halide emulsions. Tabular grains are those having two parallel major crystal faces and having an aspect ratio of at least 2. The term "aspect ratio" is the ratio of the equivalent circular diameter (ECD) of a grain major face divided by its thickness (t). Tabular grain emulsions are those in which the tabular grains account for at least 50 percent (preferably at least 70 percent and optimally at least 90 percent) of the total grain projected area. Preferred tabular grain emulsions are those in which the average thickness of the tabular grains is less than 0.3 micrometer (preferably thin—that is, less than 0.2 micrometer and most preferably ultrathin—that is, less than 0.07 micrometer). The major faces of the tabular grains can lie in either {111} or {100} crystal planes. The mean ECD of tabular grain emulsions rarely exceeds 10 micrometers and more typically is less than 5 micrometers.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435,501, 4,463,087 and 4,173,320, Daubendiek et al U.S. Pat. Nos. 4,414,310 and 4,914,014, Sowinski et al U.S. Pat. No. 4,656,122, Piggin et al U.S. Pat. Nos. 5,061,616 and 5,061,609, Tsaur et al U.S. Pat. Nos. 5,147,771, '772, '773, 5,171,659 and 5,252,453, Black et al U.S. Pat. Nos. 5,219,720 and 5,334,495, Delton U.S. Pat. Nos. 5,310,644, 5,372,927 and 5,460,934, Wen U.S. Pat. No. 5,470,698, Fenton et al U.S. Pat. No. 5,476,760, Eshelman et al U.S. Pat. Nos. 5,612,175 and 5,614,359, and Irving et al U.S. Pat. No. 5,667,954.

Ultrathin high bromide {111} tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965, and Maskasky U.S. Pat. No. 5,667,955. High bromide {100} tabular grain emulsions are illustrated by Mignot U.S. Pat. Nos. 4,386,156 and 5,386,156.

Such color silver bromoiodide elements generally have a camera speed defined as an ISO speed of at least 25, preferably an ISO speed of at least 50, and more preferably an ISO speed of at least 100. The speed or sensitivity of color negative photographic materials is inversely related to the exposure required to enable the attainment of a specified density above fog after processing. Photographic speed for color negative films with a gamma of about 0.65 has been specifically defined by the American National Standards Institute (ANSI) as ANSI Standard Number PH 2.27-1979 (ASA speed) and relates to the exposure levels required to enable a density of 0.15 above fog in the green light sensitive and least sensitive recording unit of a multicolor negative film. This definition conforms to the International Standards Organization (ISO) film speed rating.

The photographic elements processed in the practice of this invention can be single or multilayer color elements. Preferably, the elements have at least two separate light sensitive emulsion layers, and each layer contains a silver bromoiodide emulsion as defined above. Preferably the elements are multilayer color elements typically containing dye image-forming units (or color records) sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be used as well as conventional supports.

The photographic element may also comprise a transparent magnetic recording layer such as a layer containing magnetic particles on the underside of a transparent support, as described in *Research Disclosure*, November 1992, Item 34390 published by Kenneth Mason Publications, Ltd., Dudley Annex, 12a North Street, Emsworth, Hampshire PO10 7DQ, ENGLAND. Typically, the element will have a total thickness (excluding the support) of from about 5 to about 30 microns. Further, the photographic elements may have an annealed polyethylene naphthalate film base such as described in Hatsumei Kyoukai Koukai Gihou No. 94-6023, published Mar. 15, 1994 (Patent Office of Japan and Library of Congress of Japan) and may be utilized in a small format system, such as described in *Research Disclosure*, June 1994, Item 36230 published by Kenneth Mason Publications, Ltd., Dudley Annex, 12a North Street, Emsworth, Hampshire PO10 7DQ, ENGLAND, and such as the Advanced Photo System, particularly the Kodak ADVANTIX films or cameras.

In the following Table, reference will be made to (1) *Research Disclosure*, December 1978, Item 17643, (2) *Research Disclosure*, December 1989, Item 308119, (3) *Research Disclosure*, September 1994, Item 36544, and (4) *Research Disclosure*, September 1996, Item 38957, all published by Kenneth Mason Publications, Ltd., Dudley Annex, 12a North Street, Emsworth, Hampshire PO10 7DQ, ENGLAND, the disclosures of which are incorporated herein by reference. The Table and the references cited in the Table are to be read as describing particular components suitable for use in the bromoiodide elements of the invention. The Table and its cited references also describe suitable ways of preparing, exposing, processing and manipulating the elements, and the images contained therein. Photographic elements and methods of processing such elements particularly suitable for use with this invention are described in *Research Disclosure*, February 1995, Item 37038, and *Research Disclosure*, September 1997, Item 40145, both published by Kenneth Mason Publications, Ltd., Dudley Annex, 12a North Street, Emsworth, Hampshire PO10 7DQ, ENGLAND, the disclosures of which are incorporated herein by reference.

| Reference | Section | Subject Matter |
|---|---|---|
| 1 | I, II | Grain composition, |
| 2 | I, II, IX, X, XI, XII, XIV, XV | morphology and preparation. Emulsion preparation including |
| 3 & 4 | I, II, III, IX A & B | hardeners, coating aids, addenda, etc. |
| 1 | III, IV | Chemical sensitization and |
| 2 | III, IV | spectral sensitization/ |
| 3 & 4 | IV, V | desensitization |
| 1 | V | UV dyes, optical |
| 2 | V | brighteners, luminescent |
| 3 & 4 | VI | dyes |
| 1 | VI | Antifoggants and |
| 2 | VI | stabilizers |
| 3 & 4 | VII | |
| 1 | VIII | Absorbing and scattering |
| 2 | VIII, XIII, XVI | materials; Antistatic layers; |
| 3 & 4 | VIII, IX C & D | matting agents |
| 1 | VII | Image-couplers and image- |
| 2 | VII | modifyng couplers; Wash- |
| 3 & 4 | X | out couplers; Dye stabilizers and hue modifiers |
| 1 | XVII | Supports |
| 2 | XVII | |
| 3 & 4 | XV | |
| 3 & 4 | XI | Specific layer arrangements |
| 3 & 4 | XII, XIII | Negative working emulsions; Direct positive |
| 1 | | emulsions |
| 2 | XVIII | Exposure |
| 3 & 4 | XVI | |
| 1 | XIX, XX | Chemical processing; |
| 2 | XIX, XX, XXII | Developing agents |
| 3 & 4 | XVIII, XIX, XX | |
| 3 & 4 | XIV | Scanning and digital processing procedures |

The photographic elements can be incorporated into exposure structures intended for repeated use or exposure structures intended for limited use, variously referred to as single use cameras, lens with film, or photosensitive material package units.

The photographic elements may be used in association with materials that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The photographic elements may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The photographic elements may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science* and *Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred The silver bromoiodide elements of the invention are generally sold packaged with instructions to process in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support.

The invention will be illustrated by the following examples that are not meant to limit the scope.

EXAMPLE I

This example evaluates the effect of three levels of sulfite on the stability of a Rapid Access Color Negative Developers. All concentrations are in units of grams/l. The three photographic developers, described in Table I, were monitored in replicates under accelerated oxidation at 325 ml/min at room temperature in an opened glass container. The solutions were analyzed periodically for the amounts of remaining CD-4 and the change in pH. The results of these measurements are shown on Tables II and III. This study shows that lowering the sulfite improved the composition stability with little or no decrease in pH relative to the comparative rapid access formulation. However, very little or no sulfite in the developer produces Dmin stain during processing.

TABLE I

Concentration levels are in g/L.

| COMPONENT | Std | A | B |
|---|---|---|---|
| Potassium sulfite, 45% | 29.4 | 17.7 | 2 |
| Potassium bromide | 2.8 | 2.8 | 2.8 |
| Hydroxylamine sulfate | 3 | 3 | 3 |
| AC-8, 40% | 6.5 | 6.5 | 6.5 |
| Potassium carbonate, 47% | 85.11 | 85.11 | 85.11 |
| CD4 | 15 | 15 | 15 |
| Potassium iodide | 0.002 | 0.002 | 0.002 |
| K-15 (PVP) | 3.0 | 3.0 | 3.0 |
| pH | 10.48 | 10.48 | 10.48 |
| CD4/SO3 (molar ratio) | 0.61:1 | ~1:1 | 8.5:1 |
| SO3/HAS (molar ratio) | 4.6:1 | 2.73:1 | 0.33:1 |

TABLE II

| Time | CD4 remaining (%) | | |
|---|---|---|---|
| (hrs) | Std | A | B |
| 0 | 100 | 100 | 100 |
| 24 | 85.8 | 88.8 | 95.5 |
| 48 | 72.6 | 79.5 | 90.3 |
| 72 | 57.7 | 64.1 | 69.2 |

TABLE III

| Time | PH | | |
|---|---|---|---|
| (hrs) | Std | A | B |
| 0 | 10.48 | 10.48 | 10.48 |
| 48 | 10.35 | 10.33 | 10.28 |
| 72 | 10.32 | 10.32 | 10.24 |

EXAMPLE II

This example evaluates the effect of three levels of hydroxylamine sulfate (HAS) on the stability of the Rapid Access Color Negative Developer. The three photographic developers described in Table IV containing 1.5–4.5 grams/l HAS were aerated at 325 ml/min at room temperature in an opened glass container. All concentrations are in units of grams/l. Each composition was monitored periodically for the amount of remaining CD4 and HAS, and the change in pH. The results of these measurements are shown in Tables V, VI and VII.

TABLE IV

Concentration levels are in g/L.

| COMPONENT | Std | C | D |
|---|---|---|---|
| Potassium sulfite, 45% | 29.4 | 29.4 | 29.4 |
| Potassium bromide | 2.8 | 2.8 | 2.8 |
| Hydroxylamine sulfate | 3 | 1.5 | 4.5 |
| AC-8, 40% | 6.5 | 6.5 | 6.5 |
| Potassium carbonate, 47% | 85.11 | 85.11 | 85.11 |
| CD4 | 15 | 15 | 15 |
| Potassium iodide | 0.002 | 0.002 | 0.002 |
| K-15 (PVP) | 3.0 | 3.0 | 3.0 |

TABLE IV-continued

Concentration levels are in g/L.

| COMPONENT | Std | C | D |
|---|---|---|---|
| pH | 10.48 | 10.48 | 10.48 |
| CD4/SO3 | 0.61:1 | 0.61:1 | 0.61:1 |
| SO3/HAS | 4.6:1 | 9.1:1 | 3.05:1 |

TABLE V

| Time | CD4 remaining (%) | | |
|---|---|---|---|
| (hrs) | Std | C | D |
| 0 | 100.0 | 100.0 | 100.0 |
| 24 | 89.4 | 85.8 | 90.4 |
| 48 | 73.1 | 65.5 | 78.8 |
| 72 | 52.6 | 31.9 | 62.5 |

TABLE VI

| Time | HAS remaining (%) | | |
|---|---|---|---|
| (hrs) | Std | C | D |
| 0 | 100.0 | 100.0 | 100.0 |
| 24 | 71.5 | 69.9 | 82.2 |
| 48 | 38.0 | 27.4 | 55.6 |
| 72 | 7.6 | 0.0 | 16.7 |

TABLE VII

| Time | PH | | |
|---|---|---|---|
| (hrs) | Std | C | D |
| 0 | 10.5 | 10.5 | 10.5 |
| 24 | 10.5 | 10.5 | 10.4 |
| 48 | 10.4 | 10.5 | 10.4 |
| 72 | 10.4 | 10.5 | 10.3 |

It can be seen from the results in Table V, VI, and VII that increasing the level of HAS also improved the stability of the developer.

EXAMPLE III

This example compares the effect of three levels of hydroxylamine sulfate (HAS) at half the original sulfite level on the stability of the Rapid Access Color Negative Developer. All concentrations are in units of grams/l. The four photographic developers described in Table VIII containing 1.5–4.5 grams/l of HAS were monitored in replicates under accelerated oxidation at ambient temperature. The results are shown in Table IX for the amount of CD4 remaining. It is apparent that over a specific sulfite concentration range, the increased concentration of HAS improved the stability of the developer with only a small decrease in pH.

TABLE VIII

Concentration levels are in g/L.

| COMPONENT | Std | A | E | F |
|---|---|---|---|---|
| Potassium sulfite, 45% | 29.4 | 17.7 | 17.7 | 17.7 |
| Potassium bromide | 2.8 | 2.8 | 2.8 | 2.8 |

TABLE VIII-continued

Concentration levels are in g/L.

| COMPONENT | Std | A | E | F |
|---|---|---|---|---|
| Hydroxylamine sulfate | 3 | 3 | 4.5 | 1.5 |
| AC-8, 40% | 6.5 | 6.5 | 6.5 | 6.5 |
| Potassium carbonate, 47% | 85.11 | 85.11 | 85.11 | 85.11 |
| CD4 | 15 | 15 | 15 | 15 |
| Potassium iodide | 0.002 | 0.002 | 0.002 | 0.002 |
| K-15 (PVP) | 3.0 | 3.0 | 3.0 | 3.0 |
| pH | 10.48 | 10.48 | 10.48 | 10.48 |
| CD4/SO3 | 0.61:1 | 1.02:1 | 1.02:1 | 1.02:1 |
| SO3/HAS | 4.6:1 | 2.73:1 | 1.82:1 | 5.43:1 |

TABLE IX

| Time | CD4 remaining (%) | | | |
|---|---|---|---|---|
| (hrs) | Std | A | E | F |
| 0 | 100.0 | 100.0 | 100.0 | 100.0 |
| 24 | 86.9 | 91.4 | 92.1 | 87.3 |
| 48 | 69.4 | 79.3 | 83.9 | 68.5 |
| 72 | 51.6 | 65.0 | 77.5 | 47.5 |
| 96 | 29.9 | 43.6 | 58.2 | 26.8 |

EXAMPLE IV

The developing composition E in Example III above was used to process imagewise exposed samples of commercially available Kodak Royal Gold 400 and Kodak Max Zoom 800 color negative films in the following manner. The film samples were developed using solution E developing composition for 30 sec at 45 C., followed by bleach then fixer for 30 sec each then washed with the final rinse for 45 sec. The strips were allowed to air dry at room temperature. The desired color images were obtained in all of the samples.

The invention has been described in detail with particular reference to certain preferred embodiments thereof, but it will be understood that variations and modifications can be effected within the spirit and scope of the invention.

What is claimed is:

1. A method for providing a color image in an exposed color negative silver bromoiodide film element comprising contacting said element with an aqueous color developing composition having a pH of 9.0 to 12.0 and comprising a color developing agent, sulfite ion and hydroxylamine sulfate wherein the color developing agent/sulfite ion molar ratio is less than 10:1 and greater than 0.55:1, and the sulfite ion/hydroxylamine sulfate molar ratio is less than 4.35:1 and greater than 0.25:1.

2. The method of claim 1 wherein the color developing agent/sulfite molar ratio is less than 5:1 and greater than 0.75:1, and the sulfite/hydroxylamine sulfate molar ratio is less than 4.0:1 and greater than 1.25:1.

3. The method of claim 1, said composition containing the color developing agent in the amount of 0.015 to 0.068 mol/l, the sulfite ion in the amount of 0.005 to 0.095 mol/l and the hydroxylamine sulfate in the amount of 0.012 to 0.050 mol/l.

4. The method of claim 1 said composition containing the color developing agent in the amount of 0.027 to 0.055 mol/l, the sulfite ion in the amount of 0.038 to 0.089 mol/l and the hydroxylamine sulfate in the amount of 0.018 to 0.037 mol/l.

5. The method of claim 2, said composition containing the color developing agent in the amount of 0.015 to 0.068 mol/l, the sulfite ion in the amount of 0.005 to 0.095 mol/l and the hydroxylamine sulfate in the amount of 0.012 to 0.050 mol/l.

6. The method of claim 2, said composition containing the color developing agent in the amount of 0.027 to 0.055 mol/l, the sulfite ion in the amount of 0.038 to 0.089 mol/l and the hydroxylamine sulfate in the amount of 0.018 to 0.037 mol/l.

7. The method of claim 1 wherein the color developing agent is a p-phenylenediamine color developing agent.

8. The method of claim 2 wherein the color developing agent is a p-phenylenediamine color developing agent.

9. The method of claim 1 carried out in a minilab.

10. The method of claim 3 wherein the color developing agent is a p-phenylenediamine color developing agent.

11. The method of claim 4 wherein the color developing agent is a p-phenylenediamine color developing agent.

12. The method of claim 5 wherein the color developing agent is a p-phenylenediamine color developing agent.

13. The method of claim 6 wherein the color developing agent is a p-phenylenediamine color developing agent.

14. The method of claim 1 wherein the exposed color negative silver bromoiodide film element is contacted with the aqueous color developing composition at a temperature of 40° to 60° C.

15. The method of claim 2 wherein the exposed color negative silver bromoiodide film element is contacted with the aqueous color developing composition at a temperature of 40° to 60° C.

16. The method of claim 1 wherein the exposed color negative silver bromoiodide film element is contacted with the aqueous color developing composition at a temperature of 45° to 60° C.

17. The method of claim 2 wherein the exposed color negative silver bromoiodide film element is contacted with the aqueous color developing composition at a temperature of 45° to 60° C.

18. A method for providing a color image in an exposed color negative silver bromoiodide film element comprising contacting said element with an aqueous color developing composition having a pH of 9.0 to 12.0 and comprising a color developing agent in the amount of 0.027 to 0.068 mol/l, sulfite ion and hydroxylamine sulfate wherein the color developing agent/sulfite ion molar ratio is less than 10:1 and greater than 0.55:1, and the sulfite ion/hydroxylamine sulfate molar ratio is less than 4.35:1 and greater than 0.25:1.

* * * * *